US010293244B2

(12) United States Patent
Gurgel et al.

(10) Patent No.: US 10,293,244 B2
(45) Date of Patent: May 21, 2019

(54) MARTIAL ARTS RING

(71) Applicants: Jonas Lirio Gurgel, Rio De Janeiro (BR); Roberto Maluf De Mesquita, Porto Alegre (BR)

(72) Inventors: Jonas Lirio Gurgel, Rio De Janeiro (BR); Roberto Maluf De Mesquita, Porto Alegre (BR)

( * ) Notice: Subject to any disclaimer, the term of this patent is extended or adjusted under 35 U.S.C. 154(b) by 26 days.

(21) Appl. No.: 15/569,311

(22) PCT Filed: Apr. 19, 2016

(86) PCT No.: PCT/BR2016/050086
§ 371 (c)(1),
(2) Date: Oct. 25, 2017

(87) PCT Pub. No.: WO2016/183651
PCT Pub. Date: Nov. 24, 2016

(65) Prior Publication Data

US 2018/0126251 A1 May 10, 2018

(30) Foreign Application Priority Data

May 21, 2015 (BR) ..... 2020150117979

(51) Int. Cl.
*A63C 19/00* (2006.01)
*A63B 71/02* (2006.01)
*A63B 69/00* (2006.01)

(52) U.S. Cl.
CPC ..... *A63C 19/005* (2013.01); *A63B 71/02* (2013.01); *A63B 2244/10* (2013.01)

(58) Field of Classification Search
CPC ..... A63C 19/00; A63C 19/005; A63C 19/10; A63C 2019/085; A63B 69/00; A63B 69/004; A63B 71/0616
USPC ..... 472/90–94; 156/1, 106; 482/83
See application file for complete search history.

(56) References Cited

U.S. PATENT DOCUMENTS 3,388,032 A * 6/1968 Saunders ..... B32B 17/10 156/106
4,927,134 A 5/1990 Burley
5,897,438 A * 4/1999 Kunz ..... A63C 19/00 472/90
6,004,217 A 12/1999 Johnston et al.
(Continued)

FOREIGN PATENT DOCUMENTS

WO 2012120188 A1 9/2012

*Primary Examiner* — Kien T Nguyen
(74) *Attorney, Agent, or Firm* — Bay State IP, LLC

(57) ABSTRACT

The present utility model relates to the technical field of martial arts, and more particularly to a ring which is laterally surrounded by a rigid and transparent material. The proposed design aims to improve viewing for spectators and television viewers by allowing viewing, filming and photography from any angle without any obstructions, such as fencing, ropes or nets, which impede a clear view of a martial arts event. The present solution is also intended to benefit the dynamics of a fight by reducing clinch time and preventing a fighter from holding onto the fencing that currently surrounds a ring. In addition, there is the possibility of projecting images onto the outer side of the ring. In this case, spectators and television viewers will be able to view information such as, inter alia, competitor profiles, replays of fights, and sponsorship advertisements.

6 Claims, 3 Drawing Sheets

(56) References Cited

U.S. PATENT DOCUMENTS

| | | | | |
|---|---|---|---|---|
| 6,093,109 | A * | 7/2000 | Eden | A63C 19/10 472/90 |
| 2003/0070376 | A1 * | 4/2003 | Abraham | E04F 15/225 52/480 |
| 2003/0119591 | A1 * | 6/2003 | Frazier | A63B 71/022 472/88 |
| 2005/0049087 | A1 * | 3/2005 | Martin | A63B 71/022 473/415 |
| 2012/0261867 | A1 | 10/2012 | Gilkes | |
| 2013/0017895 | A1 * | 1/2013 | Mechling | A41D 13/0543 472/93 |

* cited by examiner

MARTIAL ARTS RING

CROSS REFERENCE TO RELATED APPLICATION

This application is for entry into the U.S. National Phase under § 371 for International Application No. PCT/BR2016/050086 having an international filing date of Apr. 19, 2016, and from which priority is claimed under all applicable sections of Title of the United States Code including, but not limited to, Sections 120, 363, and 365(c), and which in turn claims priority under 35 USC 119 to Brazilian Patent Application No. 2020150117979 filed on May 21, 2015.

Technological Field of the Utility Model

In general, the present utility model belongs to the technological sector of the martial arts and refers, more specifically, to a ring for the sports practice laterally surrounded by rigid and transparent material.

Known State of the Art

Currently there are several types of fights practiced by athletes around the world, among the most practiced fights there are boxing, judo, taekwondo, free wrestling, mixed martial arts, muay thai, Greco-Roman wrestling, kickboxing, jiujitsu inter alia. The practice of these fights is usually performed on rings or mats, and for each of these there are a series of rules that must be met by the athletes, in order to obtain a clean and fair play (Fair Play).

There are several ring configurations, among them is one of the most traditional and popular these days, known as octagon. The octagon is used to practice mixed martial arts, from the English Mixed Martial Arts (MMA), this type of fight includes both standing contact punches and ground fighting techniques. The known measurements, applied to this octagonal ring, consist of a floor that should measure at least 45.72 centimeters when measured from the side fences. The base of the floor must be made of multilaminate material, measuring 25 millimeters, and the floor of the ring must still be padded with a layer of at least 2.54 centimeters of foam. The padding must extend from the fences beyond the edge of the platform and must be covered by a canvas or similar material fully stretched and tied to the ring platform. Materials that tend to gather in lumps or produce protrusions should not be used.

The deck must be made of 20 mm thick plywood material and mats of E. V. A. measuring 20 mm must be placed on the padding, in addition to protection pads with coating on the upper posts and the eight corners. The internal diameter measures 8.50 meters and the height of the base 1.0 meter, and the height of the net, that must measure 1.75 meters, must be considered. The ring also needs to have at least one door, at least one access ladder, made of steel plates, four stools made of steel pipes and grids on the floor of the walkway, which should measure 0.90 meters. The accessories consist of black PVC coated 10 mm wire net as well as the column linings are made with isomanta and PVC canvas.

Among the alternatives of ring configuration there is patent PI 1107002-1 which represents a set of rings for sporting events, in which it is considered a circular structure for the ring and surrounded by nets or fences. The utility model patent MU 9102036-0 proposes an octagonal ring that is laterally surrounded by fences and capable of being converted into a square ring surrounded by ropes. From this, it is worth mentioning that the current use of fences, nets or ropes to laterally surround the fights rings cause problems regarding spectators' and viewers' visibility. This type of isolation compromises moments of the fight, in which the fence/rope/nets end up being an obstacle and prevent the visualization by who is outside the ring. In addition, such implementation makes it difficult to filming and/or covering the event.

Another drawback that involves the use of these devices that have the ring-fencing feature is that fighters often use the fence as a form of support, holding it for their own benefit, mainly for the purpose of avoiding falls. However, this action is against MMA rules and often punishment is simply a verbal warning from the fight referee. It is clear that this soft punishment ends up benefiting the offender and even if it is discounted some point of the fighter avoiding a fall may represent a significant advantage for the offender. In addition, the fact that the fence facilitates the support of the fighters increases the clinch time when at least one fighter is in contact with the net and ends up hampering the dynamics of the fight.

As the invention, subject matter of this specification, will be laterally surrounded by transparent material, it is important to take into account the fact that ice hockey also uses a transparency system for insulation of the ice rink. Hockey is practiced on a skating rink, where the rink is surrounded laterally by a kind of opaque wall, approximately one meter high, and just above is a transparent panel, approximately 1.25 meters high. Such an arrangement allows the fans to have a broad viewing from the stands and at the same time it protects them. There are some patents which refer to this type of application such as, for example, U.S. Pat. Nos. 3,388,032 and 5,897,438, as well as SE8302469 which have polycarbonate or laminated glass panels and are applied around the hockey rinks. Another alternative is shown in U.S. Pat. No. 7,077,756, which consists of a glass shell covered by plastic films composed of three layers, the panels being preferably of rectangular shape. However, in this case, although the panels have thin films applied on it with the purpose of increasing the resistance and avoiding shards in case of breaking these do not present hydrophobic properties, as proposed in the present patent.

Moreover, since panels of rigid material are proposed, there is a need to improve safety issues with the application of impact-absorbing concepts that can be implemented in transparent panels. In relation to this system, it may be mentioned patent US2012261867, which refers to safety or security devices for preventing or limiting injuries suffered by players, which collide with the equipment that is part of the hockey game. This form of protection consists of helical compression springs, gas springs, foam or a combination of these, which operate in a way to absorb the impact and can be implemented in other sports besides hockey. Another patent related to the issue of protection is SE426910, which refers to a device located at the top of the side panels, composed of sections connected to each other, wherein these sections are elastically attached to the remainder of the panel.

In relation to the protection of the panels with films, there are some patents that consist of the development of technologies aiming at the safety of the athletes and also a way to keep the panels free of dirt, that can prevent or impair the viewers' visibility. An alternative to this type of situation is disclosed in U.S. Pat. No. 5,314,7731 which relates to a form of treatment applied to glass from a reactive isocyanate solution in which layers are formed with properties that prevent water droplets from remaining adhered to the surface of the glass. However, this proposal differs significantly from the idea proposed in the solution, subject of this report, since thin protective films will be implemented instead of carrying out chemical treatment.

Thus, from the existing drawbacks regarding the use of nets, fences or ropes to encircle the martial arts rings, and for an improvement in the system of use of transparent panels, described above in the prior art, there is a need to create a ring that allows the full visualization of the combat as well as optimize the dynamics of the fight.

News and Objectives of the Solution

In order to remedy the shortcomings of the current state of the art highlighted above, the present utility model aims to propose a solution to the main problem related to martial arts rings with regard to problems regarding the visibility of combat by spectators and viewers.

The substitution of fence, ropes or nets that surround the martial arts ring and/or sports practices will improve the visibility of spectators and viewers, since the material used will be transparent, allowing also to film and photograph the event with significant quality from any angle. As the transparent material will consist of a smooth surface panel, this will allow for a more intense fight considering that there will be no possibility for any fighter to hold onto the glass for their own benefit, as occurs several times when the material laterally surrounding the ring is the fence or net. In this way, the referee's control of the fight is facilitated, since punishments applied for reasons of supporting/holding on the fence will not occur, optimizing the fair play of the event, as well as reducing the clinch time of combat, benefiting fight dynamics.

In addition, the solution in question proposes means for fixing the transparent panels to the ring structure. The proposed solution also provides for the use of films that should aid in reducing the adhesion of body fluids and possible shattering in the event of rupture of the structure.

DESCRIPTION OF THE ATTACHED DRAWINGS

For a person skilled in the art to fully understand the utility model and put it into practice, it would be described in a clear, concise and sufficient matter, based on the attached illustrative and aiding drawings, listed below:

DETAILED DESCRIPTION OF THE UTILITY MODEL

Figure 1:
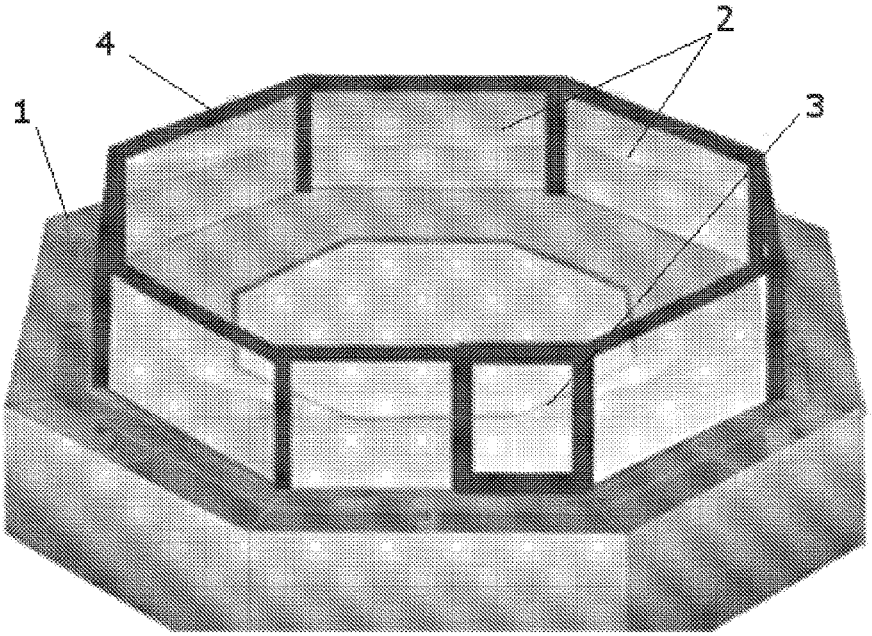
FIG. 1 represents an example of an octagonal ring having a door, laterally surrounded by panels of rigid and transparent material, in accordance with the present invention.
Figure 2:
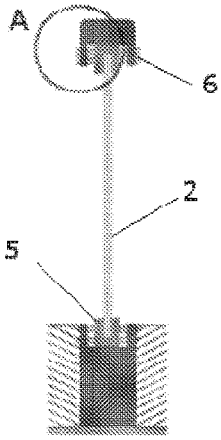
FIG. 2 represents the fastening system for panels in the ring structure.
Figure 3:
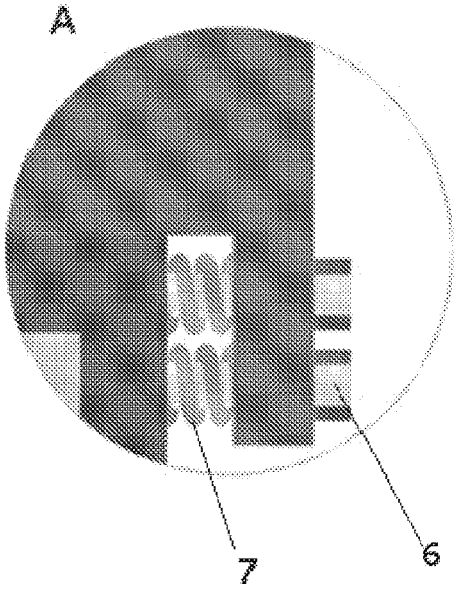
FIG. 3 represents the detail A, in enlarged scale, of the fastening system for panels in the ring structure.
Figure 4:
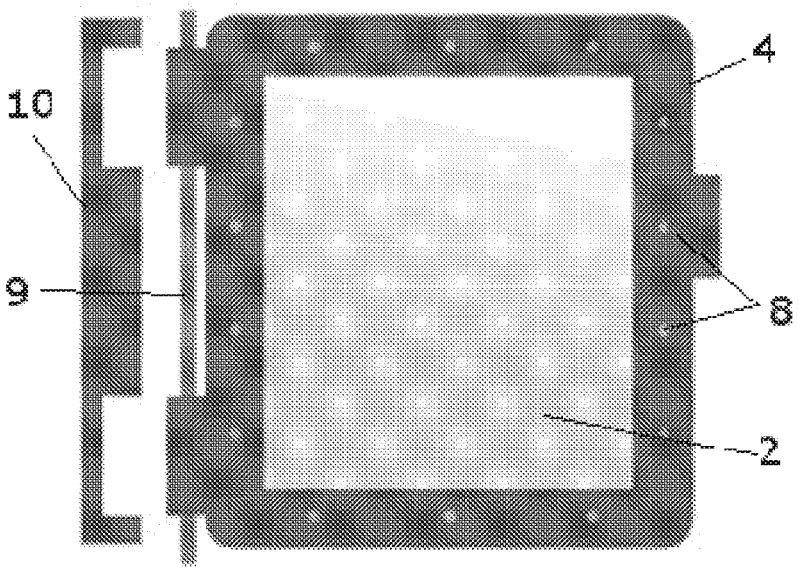
FIG. 4 represents the fixation system of the door in the ring structure.
Figure 5:
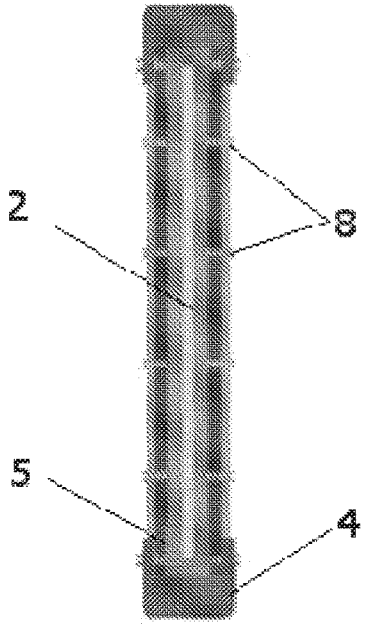
FIG. 5 represents, in section, the panel fastening means in the ring door structure for the proposed sports practices.

The ring for the practice of martial arts, object of this utility model, is surrounded laterally by rigid and transparent material. The solution in question has a raised floor (1) and a door (3) for entrance of the athletes through a ladder positioned externally, in front of the door. The ring can have many formats, and the main formats are octagonal, circular and hexagonal; this fact, however, does not exclude the possibility of other formats.

The floor, when measured from the side fences, should be made of a padded base that extends to the outer edge of the ring platform. This layer must still be covered by canvas or similar material stretched and tied to the platform.

The enclosure around the ring will consist of transparent panels (2), and the structure may be composed of any translucent material (laminated glass, acrylic, polycarbonate, etc.), with impact resistance property and mounted on the structure ring for the practice of martial arts. On each panel (2), on the front surface of the ring, thin transparent adherent hydrophobic plastic films will be applied which minimize the accumulation of body fluids, as these may negatively influence the visibility of the public, as well as reduce the coefficient of friction between the body of the fighters and the contact surface. The films have the same sizes of laminated glass sufficient to cover the entire surface of the panel. In addition, said films are intended to provide safety, since in case of material breakage, they help to avoid the dispersion of the fragments, reducing the risk of injuries of the athletes.

On the outside of the ring, on the transparent surface, there is also applied a transparent and adherent film that allows the frontal projection of images through commercial systems of projection. This system allows the opacity control of the laminated glass, allowing the viewer to receive information, such as the presentation of the fighters, replay of the fights, or announcement of sponsors at the same time as watching the fight, or at the break.

The fastening system applied to the panels will be based on the use of fastening elements (6) and springs (7), allowing the transparent structure to make small compensatory movements, reducing possible impacts and vibrations, minimizing risks of fighters being injured and acting in impact absorption. The impact absorbing system of the plates will be fastened within the ring structures through channels (5), in which the panel (2) will be inserted and fastened by the fastening elements (6) provided with springs (7). The structures are still covered by a protective layer composed of foams (4) which will be arranged between each of the panels (2) and along the entire upper end of the ring.

The access door (3) of the athletes, technical commission, event presenters and the referee is constituted by a laminated panel (2) or similar transparent material which is impact resistant. This panel (2) is affixed by fastening elements (8) along the entire structure of the door (3). The door is still coated around its perimeter by a protective layer composed of foams (4), similar to that of the upper and lower ring structure. The structure of this frame is covered by the same material of the lateral and upper columns, and only in the region of the door will there be such material at the lower edge, as observed in FIG. 1. The door also articulates with the column (10) by means of an eccentric pivot system (9), which allows the opening and closing movements. In addition, an electronically controlled lock will be implemented, with option of remote opening and affixed on the opposite side of the door axis.

Figure 6:
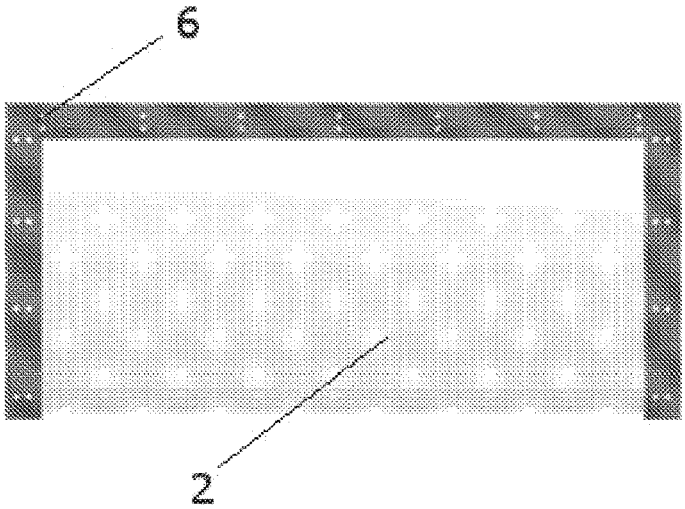
FIG. 6 represents the fastening system for the panel in the ring structure.

Moreover, as seen in FIG. 6, each side of the ring, excluding the side with the access door, which is composed of a panel (2) of transparent and impact resistant material will be affixed to the top, bottom and sides of the ring structure by means of fastening elements (6) and springs (7), as previously described.

It is important to point out that the figures and the description made are not intended to limit the execution of the inventive concept proposed herein; but to illustrate and make understandable the conceptual innovations disclosed in this solution. Thus, the descriptions and images are to be interpreted as illustrative and non-limiting, and there may be other equivalent or analogous forms of implementation of the inventive concept herein disclosed and which do not depart from the protection spectrum outlined in the proposed solution.

The present specification relates to an improvement in the configuration of rings for practicing martial arts, endowed with novelty, inventive act, descriptive sufficiency, industrial application and, consequently, fulfilling all the essential requirements for the grant of the claimed protection.

The invention claimed is:

1. An improvement for a martial arts ring comprising:
- a ring;
- a raised floor;
- a series of transparent panels positioned around the ring to create an enclosure;
- a fastening system to connect and insert each transparent panel into a corresponding channel embedded in the raised floor, wherein the fastening system comprises:
  - a fastening element; and
  - a spring;
  - wherein each transparent panel is secured in the ring by the fastening element and the spring once the transparent panel is inserted into the channel;
- an access door, wherein the access door is affixed by fastening elements and a column with an eccentric pivot system to allow for the access door to open and close to enter the ring.

2. The improvement for a martial arts ring of claim 1, wherein the raised floor comprises a padded base that extends to an outer edge of the ring.

3. The improvement for a martial arts ring of claim 1, wherein the series of transparent panels is made of a material selected from the group consisting of: laminated glass, acrylic and polycarbonate.

4. The improvement for a martial arts ring of claim 1, wherein each transparent panel further comprises a hydrophobic film adhered to the transparent panel to minimize the accumulation of body fluids.

5. The improvement for a martial arts ring of claim 1, wherein the spring of the fastening system enables the martial arts ring to make small compensatory movements for impact absorption.

6. The improvement for a martial arts ring of claim 1, wherein the series of transparent panels and the access door are covered by a protected layer of foam between each panel and along an upper end of the ring.

* * * * *